United States Patent [19]

Neumann et al.

[11] Patent Number: 4,984,993

[45] Date of Patent: Jan. 15, 1991

[54] TWO-PIECE EDGE ZIF CONNECTOR WITH SLIDING BLOCK

[75] Inventors: Eugene F. Neumann; Melvin C. August; Stephen A. Bowen, all of Chippewa Falls, Wis.

[73] Assignee: Cray Research, Inc., Chippewa Falls, Wis.

[21] Appl. No.: 351,871

[22] Filed: May 12, 1989

[51] Int. Cl.[5] ..... H01R 13/629

[52] U.S. Cl. ..... 439/157; 439/310; 439/347; 439/368

[58] Field of Search ..... 439/310, 259, 261, 360, 439/256, 157, 310, 347, 368

[56] References Cited

U.S. PATENT DOCUMENTS

| | | | |
|---|---|---|---|
| Re. 32,559 | 12/1987 | Fedder et al. | 439/325 |
| 330,466 | 11/1885 | Brown . | |
| 2,724,093 | 11/1955 | Preston | 339/75 |
| 3,161,733 | 12/1984 | Bowser et al. | 200/16 |
| 3,392,245 | 7/1968 | Asick | 200/16 |
| 3,459,998 | 8/1969 | Focarile | 317/100 |
| 3,526,869 | 9/1970 | Conrad et al. | 339/75 |
| 3,537,063 | 10/1970 | Beaulieu | 339/74 |
| 3,541,490 | 11/1970 | Berg | 339/75 |
| 3,541,494 | 11/1970 | Berg | 339/75 |
| 3,576,515 | 4/1971 | Frantz | 339/74 |
| 3,591,219 | 5/1986 | Reimer | 339/17 |
| 3,648,221 | 3/1972 | Tillmann et al. | 339/74 |
| 3,793,609 | 2/1974 | McIver | 339/74 |
| 3,899,234 | 8/1972 | Yeager et al. | 339/74 |
| 3,977,747 | 8/1976 | Broutros | 339/74 |
| 3,982,807 | 9/1976 | Anhalt et al. | 339/75 |
| 4,062,610 | 12/1977 | Doty et al. | 339/75 |
| 4,076,362 | 2/1978 | Ichimura | 339/75 |
| 4,077,689 | 3/1978 | Feldberg | 339/75 |
| 4,080,027 | 3/1978 | Benasutti | 339/17 |
| 4,159,154 | 6/1979 | Arnold | 339/74 |
| 4,159,861 | 7/1979 | Anhalt | 339/75 |
| 4,178,053 | 12/1979 | Eifort | 339/75 |
| 4,220,382 | 9/1980 | Ritchie et al. | 339/17 |
| 4,261,631 | 4/1981 | Guilcher et al. | 339/75 |
| 4,272,143 | 6/1981 | Weiss | 339/74 |
| 4,288,139 | 9/1981 | Cobaugh et al. | 339/74 |
| 4,327,955 | 5/1982 | Minter | 339/74 |
| 4,350,402 | 9/1982 | Douty et al. | 339/74 |
| 4,392,700 | 7/1983 | Showman et al. | 339/17 |
| 4,400,049 | 8/1983 | Schuck | 339/176 |
| 4,428,635 | 1/1984 | Hamsher, Jr. et al. | 339/74 |
| 4,451,818 | 5/1984 | Grabbe et al. | 339/75 |
| 4,487,468 | 12/1984 | Fedder et al. | 339/75 |
| 4,514,784 | 4/1985 | Williams et al. | 361/386 |
| 4,540,228 | 9/1985 | Steele | 339/74 |
| 4,542,950 | 9/1985 | Gillett et al. | 339/75 |
| 4,560,221 | 12/1985 | Olsson | 339/75 |
| 4,591,218 | 5/1986 | Reimer | 339/17 |
| 4,597,619 | 7/1986 | Reimer | 339/75 |
| 4,626,056 | 12/1986 | Andrews, Jr. et al. | 339/75 |
| 4,629,270 | 12/1986 | Andrews, Jr. et al. | 339/75 |
| 4,684,194 | 8/1987 | Jenkins et al. | 439/260 |
| 4,700,996 | 10/1987 | August et al. | 439/268 |
| 4,744,764 | 5/1988 | Rubenstein | 439/62 |
| 4,813,128 | 3/1989 | Massopust | 29/830 |

FOREIGN PATENT DOCUMENTS

| | | |
|---|---|---|
| 3730020 | 9/1988 | Fed. Rep. of Germany . |

OTHER PUBLICATIONS

ITT Cannon Brochure entitled "PC Edgecard Connector PB21/PB18 Series".

ITT Cannon Brochure entitled "Zero Insertion Force Modular Edgecard Connectors".

*Primary Examiner*—Gary F. Paumen

*Attorney, Agent, or Firm*—Merchant, Gould, Smith, Edell, Welter & Schmidt

[57] ABSTRACT

An electrical end connector (10) of the zero insertion force type includes a pair of opposing blocks (21, 40), one of which blocks is slideably mounted in a housing (22). Opposite corresponding pairs of female receptacles (34) and male pins (31) are cooperatively mounted on the opposing blocks (21, 40). The housig (22) has two sets of oppositely disposed windows formed through the longitudinal ends. One block (40) has a channel formed therethrough, such that the block (40) is urged transversely upon insertion of a cam-like slider device (70), thereby selectively engaging or disengaging the male pins (31) and female receptacles (43).

19 Claims, 5 Drawing Sheets

TWO-PIECE EDGE ZIF CONNECTOR WITH SLIDING BLOCK

TECHNICAL FIELD OF THE INVENTION

The present invention relates generally to an electrical connector, and more particularly to a zero insertion force ("ZIF") type edge connector wherein a plurality of electrical contacts are established or interrupted by one or more slideable transverse shuttles, each shuttle carrying a plurality of connectors to engage with stationary connectors, said shuttles responsive to the longitudinal insertion of a cam apparatus.

BACKGROUND ART

High-speed electronic digital computers of the type produced by Cray Research, Inc., the assignee hereof, utilize banks of interconnected circuit modules. Each circuit module typically includes two printed circuit boards mounted on opposite sides of a heat sink (herein referred to as a "cold plate"). Each circuit board in turn includes numerous integrated and discrete circuit, logic, and memory devices. Computers of this type tend to have high circuit densities and numerous input and output signals, connections for which must be provided. Further, the trend is toward computers of greater capacity, increasing circuit densities, and thus even more connections.

A variety of electrical connectors have been available heretofore for use with printed circuit boards, however, there have been certain drawbacks with the prior connectors. The most common approach has been to provide a plug-in type connector consisting of complementary male and female contacts including numerous pins for simultaneously making or breaking multiple contacts. As the number of pin contacts increases, however, the insertion force required to connect the male and female contacts also increases, along with the chances of misalignment and thus damage. It will be appreciated that connectors of this type are not especially tolerant to misalignment and the pins therein can easily become damaged during attempted connection if misaligned even slightly.

U.S. Pat. No. 4,352,533 shows a connector device for printed circuit boards comprising a pair of opposed male portions and an intermediate slideable shuttle portion. The male portions include opposing aligned pins, the pins on one portion being relatively longer than those on the other portion. The female shuttle includes dual entry female contacts which are supported by and moveable along the long pins of one male portion into or out of engagement with the short pins on the other male portion to make or break electrical contact.

On the other hand, the PB 18 printed circuit board connector assembly from ITT Cannon of Mountain Valley, Calif., utilizes a cam for sequentially opening or closing pairs of contacts in zipper fashion. This connector, however, utilizes pre-loaded spring contacts which are normally biased toward engagement with finger contact pads on the edge of the PC board. This type of connector is thus a zero-insertive force-type connector, but relies upon spring tension for surface pressure contact, which is not as reliable as a wiping action type of connection. Further, the slider must be left in place to keep the spring contacts open. This connector also tends to be somewhat bulky.

U.S. Pat. No. 4,700,996, issued to the assignee hereof, illustrates a ZIF type connector utilizing a wiping action type contact. This connector, however, may be improved in a higher connection/density environment. Further, the impedance and other electrical effects of the connector may similarly be improved as the trend toward greater circuit densities and connections increase.

Therefore, there is a need for a new and improved ZIF edge connector of shorter electrical path and controlled impedance wherein electrical contact is established or interrupted sequentially, in either a coaxial or twisted pair environment, utilizing a wiping action type electrical connection, with such connector having greater reliability, alignment and electrical characteristics.

SUMMARY OF THE INVENTION

The present invention provides an improved two block edge ZIF connector that overcomes the foregoing and other difficulties associated with the prior art. In accordance with the principles of the invention, there is provided an electrical connector, of the zero insertion force type, wherein a plurality of electrical contacts are established or interrupted sequentially by groups, rather than en masse, responsive to insertion of a rod, more specifically a slider device having a cam-like edge (hereinafter referred to as "slider" for convenience).

In a preferred embodiment of a device constructed according to the principles of the present invention, the connector comprises a pair of opposing connector block portions. The first block is adapted for mounting on the frame of a computer. The second block is adapted for mounting along the edge of, or proximate to, a circuit board. The first block is fixedly mounted (the mounting may provide for a certain degree of motion in order to exhibit greater alignment characteristics, as will be described further below), while the second block is slidably mounted within a frame or housing. Each housing may contain a plurality of second blocks, with individual blocks being slideable exclusive of the other blocks. The housing is preferably mounted longitudinally along the edge of the circuit board, with the slideable motion exhibited by the second block(s) therefore referred to as "transverse".

Female and male connectors are cooperatively mounted on the opposing slideable/shuttle (second) and stationary (first) blocks, with the respective connectors being mounted in a complementary fashion (i.e., male connectors on one block and complementary female connectors on the other block). A slider engages the second blocks sequentially and urges them transversely within the housing toward the stationary block. The transverse movement causes the male and female connectors to cooperatively engage in their intended manner so as to establish an electrical connection or signal path. Insertion of the slider in a different manner (i.e., rotated about its longitudinal axis 180°) reverses the process and interrupts the connections by moving the shuttle blocks away from the stationary block. The slider therefore, actuates the male and female connectors into or out of engagement by groups.

One feature of the present invention is that the male connectors incorporate a positive locking feature in conjunction with the first block. A pawl-type protrusion, engages a detente formed within the first block. Therefore, when the male connectors are inserted into the first block, the pawl engages the detente while a shoulder, located on the connector abuts the first block. In this manner each of the male connectors are firmly engaged within the first block. By allowing relative movement, the male connector may be disengaged from the first block. In a preferred embodiment, such movement is provided by utilizing a tuning fork type shape, however, other shapes may similarly be utilized. Such an arrangement allows for quickly reconfiguring the connector and replacing faulty components.

Another feature of the present invention is the utilization of integrally formed female connectors within the second blocks. Such connectors are used together with a flexible circuit. The flexible circuit allows the second block to move transversely and provides a shorter electrical path.

A further feature of the invention is the use of "windows" formed in the housing to guide the slider. The windows are located at the longitudinal ends of the housing and comprise alignment means for the slider. Two sets of windows are preferably utilized. The first set is aligned so that the insertion of the slider causes engagement with the second block to urge the second block toward the first block. Insertion of the slider through the second set of windows aligns the slider to cause relative movement of the second block away from the stationary block.

Also, provided are alignment means for positively guiding the second block toward the male connectors as the second block is urged transversely by the slider. In the preferred embodiment, the alignment means include complementary alignment notches. The notches open into one another. An alignment member or tab is provided at the top of each second block to cooperatively engage with the notches. Therefore, as the slideable second blocks are sequentially urged toward the stationary first block, and each set of female receptacles on the specific second block moves to engage a specific set of male pins, the notches properly align the connectors to avoid damaging the same. The alternative embodiment utilizes an alignment pin and other types of apparatus, such as blades, could also be utilized.

Still another feature of the present invention is providing the stationary first block with a degree of freedom so as to properly align in the z-axis direction (the connector's longitudinal mounting defining the x-axis, the horizontal transverse axis of the connector defining the y-axis and the line normal to the plane formed by the x-axis and y-axis defining the z-axis). The stationary blocks are mounted such that the heatsink on which the shuttle housing is mounted positively bias the stationary blocks and thereby align the connectors in the z direction.

Therefore, according to one aspect of the invention there is provided an electrical connector, of the zero insertion force type, comprising: (a) a first housing and a second housing, said first and second housing generally aligned side by side and said second housing having end walls defining guide holes; (b) a first connector cooperatively mounted in said first housing and a second connector slideably mounted in said second housing, wherein said first and second connectors form an electrical path when engaging one another and wherein said second connector has a channel formed therethrough, whereby when an insertion bar is selectively inserted through said guide holes and said channel, then said second connectors cooperatively engage with or disconnect from said first connector.

These and other advantages and features which characterize the present invention are pointed out with particularity in the claims annexed hereto and forming a further part hereof. However, for a better understanding of the invention, its advantages and objects attained by its use, reference should be made to the Drawing which form a further part hereof and to the accompanying descriptive matter, in which there is illustrated and described a preferred embodiment of the present invention.

BRIEF DESCRIPTION OF THE DRAWINGS

In the Drawings wherein like parts are referenced by like numerals throughout the several views.

DETAILED DESCRIPTION

The principles of this invention apply particularly well to the interconnection of signal flow paths in a computer type environment. A preferred application for this invention is in a computer environment requiring high density connections, high frequency/speed signals and controlled impedance of signal paths. Such preferred application, however, is typical of only one of the innumerable types of applications in which the principles of the present invention can be employed.

In a connector environment with high density, the electrical connections per unit of connector is a critical concern. Similarly, the length of the connection for which there is little or no impedance control (i.e., no twisting or shielding) is of great concern. The principles of the present invention address these concerns.

To illustrate the improvement in density provided by a connector constructed according to the principles of the present invention, consider a standard edge connector utilizing a series of connections, arranged in a typical one-connection-per-unit-length of connector fashion. In the preferred embodiment of the present invention, however, four connections are provided per unit length of connector. By increasing the number of connections per unit length of connector, the effective length of the connector is increased by a factor of four, while maintaining the same actual length. Alternatively, assuming that the same number of connections are to be established, the actual length of a connector constructed according to the principals of the present invention may be decreased by the factor increase of the effective length. Those skilled in the art will recognize that the number of connections per unit length is a design choice and that while there are four connections in the preferred embodiment, the present invention is not so limited.

Figure 1:
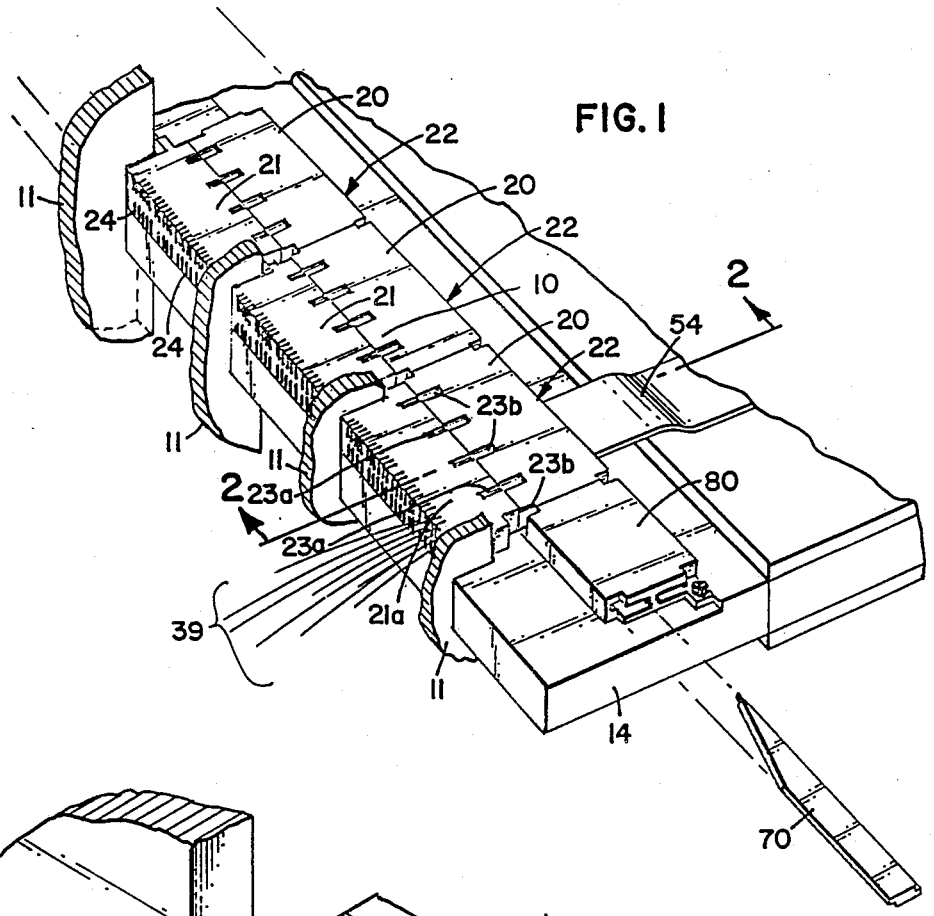
FIG. 1 is a perspective view of a preferred embodiment of a ZIF edge connector constructed according to the principles of the present invention.

Referring now to the Figures, there is illustrated preferred embodiments of a ZIF edge connector configured in accordance with the principles of the present invention. Referring first to FIG. 1, there is shown circuit module 12 and a frame 11 of a computer (not shown) interconnected by the ZIF edge connector 10 of this invention. The frame 11 includes end plates (not shown), and a number of intermediate bars (not shown) arranged in opposing, laterally spaced-apart pairs. The adjacent edges of the end plates and bars are notched or slotted as shown for receiving a stack or bank of circuit modules therein. A more detailed description of frame 11 is set forth in U.S. Pat. No. 4,700,996 which is hereby incorporated herein by reference. Frame 11 includes cold plate receiving notches 56.

The circuit module 12 includes a pair of printed circuit boards 13 arranged on opposing sides of a cold plate 14. Flanges (not shown) are provided on an opposite lateral side to the cold plate 14 for receipt within the notched edges between the end plates and the intermediate bars of the frame (as shown in U.S. Pat. No. 4,700,996).

As will be explained more fully below, the ZIF connector 10 of the invention is mounted along edges of the circuit module 12 and are adapted to provide essentially zero mechanical resistance upon insertion of the circuit modules 12 into the frame 11. The second blocks 40 (described below) located along each edge of the module 12 can then be sequentially actuated, somewhat in the fashion of a zipper, to establish multiple electrical connections with better reliability, controlled impedance and shorter electrical connections then achieved with previous style connectors. Although termed a ZIF connector, as will be appreciated by those skilled in the art, mechanical resistance is encountered when establishing the electrical connections. This resistance is dependant upon several factors described more fully below.

Still referring to FIG. 1, the ZIF connector 10 is illustrated as being comprised of a plurality of connector sections 20. Each section 20 includes a stationary or first block 21 with a plurality of male pins 31 located therein (best seen in FIGS. 2 and 3) and a second block housing 22 having second, or shuttle, blocks 40 slideably mounted therein. Those skilled in the art will recognize, however, that in order to practice the principles of the present invention only a single stationary block 21 and a single shuttle block 40 are required. In the preferred embodiment, however, a plurality of shuttle blocks 40 are utilized correspondingly with each stationary block 21. Connector section 20 is one of a plurality of connector sections, connector section **20*a* is one of a plurality of sections 20, which together comprise connector 10, only one connector section 20** is required in order to practice the principles of the present invention.

As noted, stationary block 21 is typically connected to a main frame of a computer assembly or other signal processing device (e.g., a motherboard) desired to be connected to a printed circuit board or card. The stationary block 21 has one or more alignment notches **23*a* located through the block top in order to facilitate alignment between the connector blocks 21 and shuttle blocks 40** (as discussed further below).

It will be apparent to those skilled in the art that numerous notches **23*a*, *b* and slots 24 are illustrated in the accompanying figures. It should be noted that no effort has been made to correlate each and every notch 23*a*, *b* and slot 24 to those illustrated. Further, although a notch 23*a*, *b*** is illustrated as the preferred alignment guiding means, other methods including pins, blades or other similar features might similarly be used.

Located on the rear of the stationary block 21 (i.e., that side located farthest from the shuttle housing 22) are a plurality of slots 24. The slots 24 extend through the stationary block 21 and receive the inserted male connection devices 30. In the preferred embodiment, there is one male device 30 located within each slot 24. The actual number of slots 24 is dependent in part upon the density of the signal paths which are desired to be established/connected by the connector 10.

Located within the slot 24 (on the uppermost interior face) there is a detente 32 (best seen in FIGS. 2 and 3) which engages a pawl-like device 36 on the male device 30 (described further below) serving to retain the male device 30 therein. The detente 32 is comprised of a cut shoulder within the housing 21. Preferably such detente 32 is molded or constructed in the housing 21.

The stationary block 21 is preferably constructed of a high performance, impact resistant thermoplastic, for example Vectra® A5-P5. However, other materials which preferably exhibit chemical, flammability and arc resistance, as well as electrical insulating characteristics may be used. Also preferable are material characteristics which provide for greater alignment, low warpage and mold shrinkage. However, those skilled in the art will recognize that any dimensionally stable, electronic grade material which is non-conductive may be used.

Figure 6:
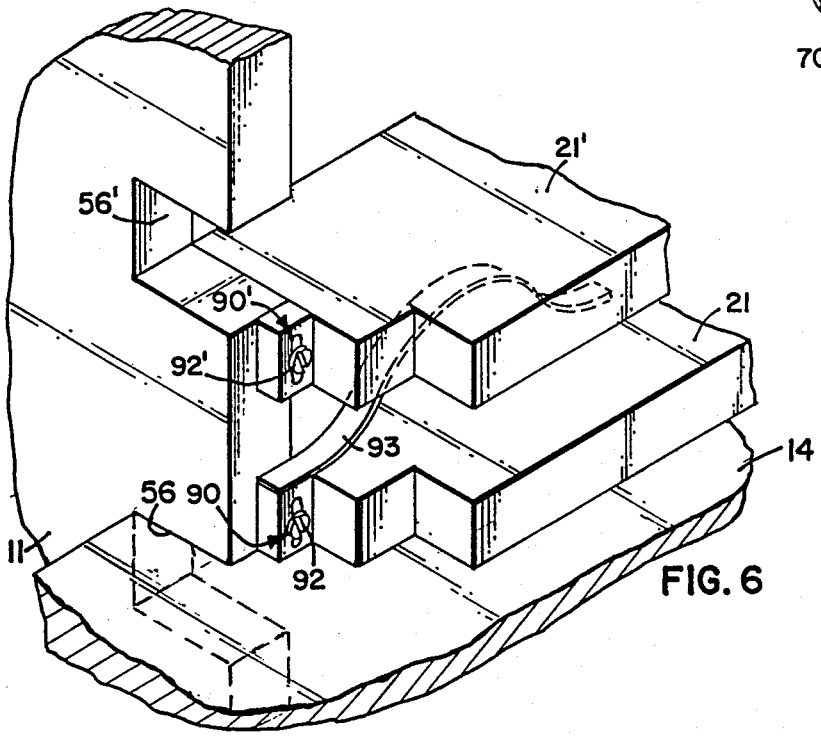
FIG. 6 is an enlarged fragmented perspective view of a portion of the ZIF edge connector of FIG. 1.

Shoulder screw 92 passes through slot 90 thus mounting stationary housing 21 to frame 11 (best seen in FIG. 6) such that spring 93 forces housing 21 against cold plate 14 which limits and provides alignment in the z direction. This method of mounting provides a degree of freedom for the stationary block 21. The movement is limited to the z direction and is limited to a given distance so that proper alignment with the second block 40 is ensured. The degree of freedom is provided by the slotted hole 90 in stationary housing 21 through which screw 92 extends. The spring 93 is biased when the leading edge (not shown) of cold plate 14 is inserted into the frame 11 and the edge of cold plate 14 encounters that particular stationary block 21. The leading edge is chamfered so as to engage stationary block 21 properly, while each spring 93 which is biased exerts a force against the corresponding stationary block to position the connector 21 against the cold plate 14 and thereby positions the stationary connector 21 in the z direction. As best seen in FIG. 6, cold plate 14 is inserted into notch 56 of Frame 11. Connector 21 is biased against the upper surface of cold plate 14. An additional cold plate (not shown) is inserted into notch 56', thereby providing a firm surface against which the spring 93 biases connector 21'.

Those skilled in the art will appreciate that each spring 93 can bias two connectors 21, 21' simultaneously (FIG. 6) or there may be one spring 93 per connector 21. One end of spring 93 is connected to frame 11, with a second end biasing connector 21, and (optionally) a middle section biasing a connector 21' of a second set of connectors. As those skilled in the art will recognize, other methods of mounting spring 93 are possible.

When referring to directions relating to the x, y and z axis, the following definitions apply. The series of mounted stationary blocks 21 define the x axis (also defining the x direction is the direction of insertion of slider 70 as illustrated), while the horizontal slots 24, which are perpendicular to x, define the y axis. The z-axis is, therefore, perpendicular to the plane formed by the x and y axis.

Figure 2:
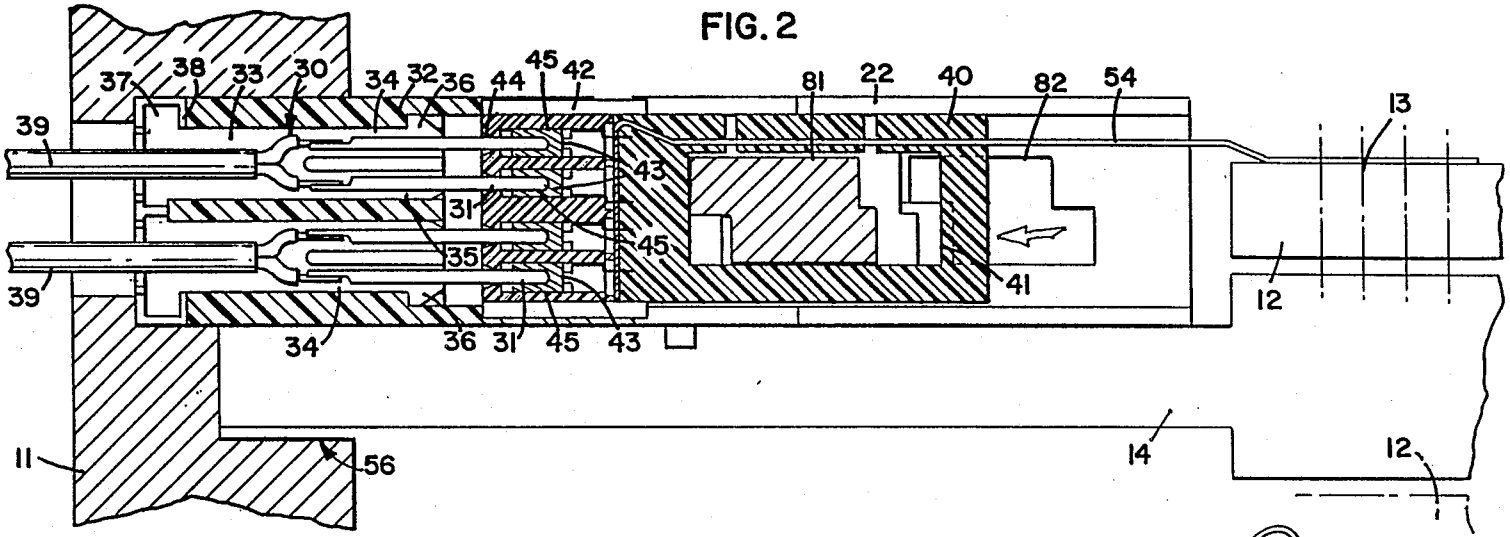
FIG. 2 is a cross section view of the ZIF edge connector of FIG. 1 taken through the line 2—2.

Referring next to FIG. 2, there is illustrated a cross section view of connector 10 where it may be seen that in the preferred embodiment, the male device 30 is approximately tuning fork-shaped. Male device 30 is designed for a twisted pair 39 environment. Male device 30 allows the twisted pair 39 to remain twisted proximate to the conjugation of the body of male device 30 and tines 34. Such a configuration is desired in order to limit the unshielded portion of the signal flow path. This arrangement thereby reduces the antenna effects and signal noise presented by other connectors.

Continuing with the preferred embodiment tuning fork-shape analogy, each male connector device 30 has a handle portion 33 and two tines 34 and 35. The male connector 30 is preferably molded of a dimensionally stable plastic such as Vectra® A5-P5. However, any type of material which exhibits electrically insulating, dimensionally stable, electronic grade resilient characteristics may also be used, as those skilled in the art will recognize.

Extending from at least one tine 34, 35 of the male device 30 is a pawl shaped protrusion 36. Such protrusion 36 is mounted on the tine 34 to engage the detente 32 of the stationary housing 21. Other arrangements and configurations of the male device 30 are possible, including square, rectangular, and other variously shaped members as those skilled in the art will recognize.

As noted, preferably, the male device 30 is made of a resilient, nonconductive material. The tines 34, 35 are thereby able to move toward one another in accordance with the resiliency of the material upon the application of a "squeezing" force upon the times 34, 35. This relative movement of the times 34, 35 disengages the pawl 36 from the detente 32, at which time the male device 30 may be removed rearward from stationary block 21. Other means to disengage the locking feature of male device 30 may similarly be used. Further, as those skilled in the art will recognize slots 24 must be appropriately sized, dependant in part upon the distance between the tines 34, 35, in order to engage male device 30 as intended.

Located proximate the rear of the handle portion 33 of male device 30 is a positive shoulder stop 37 which abuts up to shoulder 38 of stationary housing 21. This shoulder 27 helps insure that the male device 30 is inserted into stationary housing 21 in the proper alignment, and thereby the proper polarity of the twisted pair wire is insured. The male device 30 is thereby held firmly in place transversely (y-direction) between first and second shoulders 32 and 38 respectively. Device 30 is engaged firmly in the x and z directions within stationary block 21 by appropriate sizing of slot 24.

As will be apparent to those skilled in the art, each male device 30 includes two male pins 31 extending therefrom for insertion into female receptacles 43 (described below). The pins 31 are connected to the twisted pair by soldering, crimping or other methods well known to those skilled in the art. Such pins 31 are preferably constructed of a gold plated beryllium copper. Preferably, there is one pin 31 for each signal path to be established.

Still referring to FIG. 2 there is also illustrated a cross section of a shuttle housing 22 for housing the female blocks of the connector 10.

On the roof of the shuttle housing 22 is an alignment notch **23*b* which aligns and corresponds with previously described alignment notch 23*a*. Formed through shuttle housing 22 are two sets of windows 81, 82, one window of each set being located on the opposite longitudinal (x-direction) ends of housing 22. Each of the window sets 81, 82 are aligned such that a line drawn between corresponding points is parallel to the x-axis. The windows 81, 82 of differing sets are located in the transverse direction (y-direction) relative to one another. In the front (i.e., that side facing stationary block 21) of housing 22 is an opening through which shuttle block 40 can extend when urged transversely toward stationary block 21. In the rear of housing 22 is a second opening through which the electrical connections to female receptacles 43 of shuttle block 40** can extend.

It will be appreciated that several windows could be used or one window arranged and configured with appropriate channel(s) to impart the desired transverse force.

The shuttle housing 22 is mounted preferably on the tongue of the cold plate 14 or otherwise immediately adjacent to the printed circuit board 13 to which the female connectors 40 are connected.

Next, referring to the female receptacle 43 carrying shuttle block 40, there are four such shuttles 40 located within each housing 22. Each shuttle contains a channel 41, formed therethrough, which is aligned longitudinally (i.e., in the x-direction). The channel 41 is preferably formed in the second half of a two shot molding process. Mounted on the top of the shuttle 40 is a guide tab 42 which extends into the notches **23*a*, 23*b* to provide positive alignment of the first and second blocks 21, 40**.

The shuttle block 40 is preferably constructed in two steps. The portion of shuttle block 40 constructed in the first step being proximately square in shape and having a plurality of chamfered holes 44 formed therein opening into openings 45 into which the female receptacle electrical contacts 43 are inserted. The contacts 43 are then connected to a flex circuit 54. The flex circuit 54 preferably comprises of a Kapton® polyimide substrate with metal traces (not shown) thereon. Flex circuit 54 also preferably is comprised of a ground plane to control impedance and reduce noise.

The second step of the two step process embeds a portion of the flex circuit 54. The second piece is square in shape with channel 41 formed therethrough, as described above. Such shuttle block 40 is then slideably mounted within the shuttle housing 22.

Those skilled in the art will recognize that one contact per signal path to be created, as described above, is preferred. Similarly, the female receptacles 43 must be constructed so as to align with the corresponding male pin 30 in order for connector 10 to operate in its intended manner. Those skilled in the art will appreciate that due to the wiping action type contact of connector 10, certain mechanical resistance is encountered during connection. This resistance may be increased or decreased by including a greater or lesser number of shuttles 40 per housing 22, and/or including a greater or lesser number of contacts per shuttle 40. The actual number of contacts per shuttle 40, and shuttles 40 per housing 22 are thereby a matter of design choice.

The female receptacles 43 are constructed of a gold plated beryllium copper and are cooperatively connected to the flex circuit 54 by soldering, ultrasonic welding or other means well known to those skilled in the art. The shuttle block 40 is constructed of a dimensionally stable, electronic grade, non-conductive plastic. As described above in connection with the stationary block 21, other materials may be used to construct shuttle block 40.

Figure 5C:
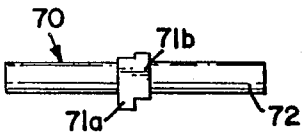
FIG. 5*c* is an end view of the slider of FIG. 5*a;*
Figure 5A:
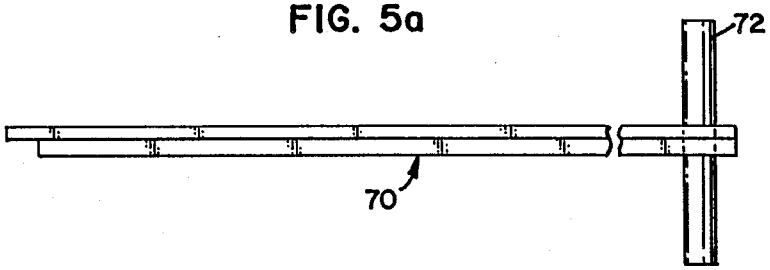
FIG. 5*a* is a side elevational view of a slider, with portions broken away, used with the connector of FIG. 1.
Figure 5B:
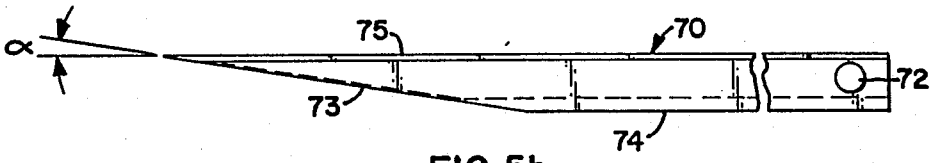
FIG. 5*b* is an enlarged top view of a portion of the slider of FIG. 5*a;*

Referring next to FIGS. 5*a*, 5*c* there is illustrated a preferred embodiment of the slider (insertion cam tool) 70 which is used to impart the transverse movement to the shuttle block 40. As illustrated in FIG. 5*a*, the slider 70 has approximately a rectangular side plan form. As illustrated, however, slider 70 has oppositely machined edges such that two diagonally opposing edges overlap the adjacent edge in order to provide more secure engagement with shuttle channel 41.

The cross section view of FIG. 5*c* illustrates slider's 70 construction comprising two offset rectangle shaped portions 71*a*, 71*b* with handle portion 72 cooperatively connected at one end. The portion of the rectangles which are offset form the overlapping edges.

Slider 70 also has a tapering edge 73 which tapers at an approximately 15° degree angle $\alpha$ from one side edge 74 to the other side edge 75. This angle is measured relative to the longer side edge 75. The angle is provided by way of illustration only, with the exact angle being a matter of design choice. As those skilled in the art will recognize, the angle of tapering edge 73 is a factor in the mechanical resistance encountered when connecting the male pins 31 and female receptacles 43. Other cam-like devices and equivalents could be used. For example, a cam having a "single" cam edge or a plurality of cams arranged and configured so as to impart transverse movement to the shuttle(s) 40 may be used.

Slider 70 is constructed of a metal, and preferably of a stainless steel. However, any material which is able to withstand the forces of insertion and does not damage windows 41 might be used.

Guide means 80 are provided proximate to the shuttle housing 22 to align the slider 70 described above. Such guide means 80 may be constructed of any style of material which is physically able to withstand the insertion of slider 70. However, preferably alignment block guide means 80 are made of a high performance plastic as described above.

Figure 3:
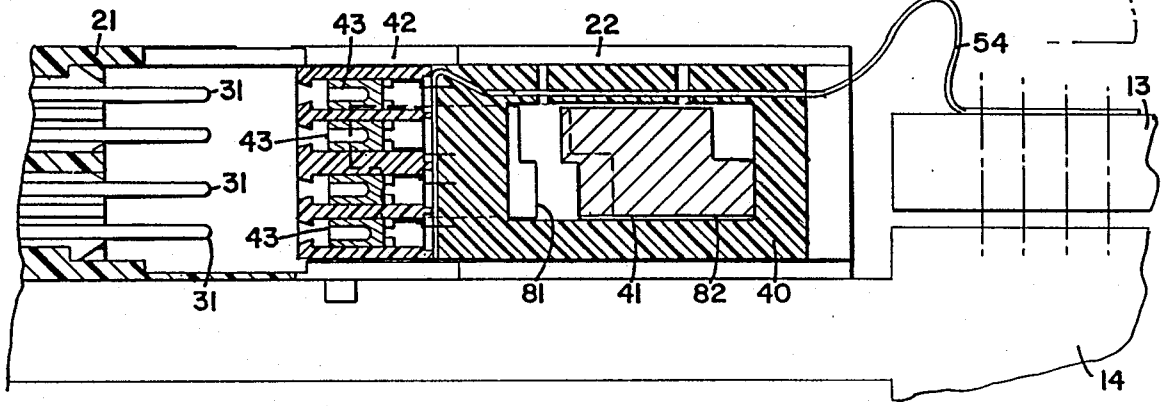
FIG. 3 is cross sectional view of the ZIF edge connector of FIG. 2 with the shuttle retracted into the housing.

In operation (best seen in FIG. 4), each of the shuttle blocks 40 start in a non-operational position fully retracted within the shuttle housing 22 (best seen in FIG. 3). The cold plate 14 (or other structure on which the shuttles 40 are located) is then inserted into a groove 56 in the computer frame 11. The groove 56 is located beneath the stationary blocks 21. The spring 93 is located so as to bias the stationary block 21 firmly against the cold plate 14. The edge of the cold plate 14 may be appropriately shaped or cut to avoid damaging the stationary block 21 during the insertion of the cold plate 14, or ZIF step.

Once the cold plate 14 is fully installed, then the slider, or insertion tool, 70 is then inserted into the guide means 80 and subsequently through the window 41 of shuttle housing 22.

The tip 73 of the slider first pierces the window of the shuttle 40. As the tip progresses through the window, the shuttle 40 is driven forward (i.e. transversely) toward the stationary block 21. The shuttle is driven by the cam effect of the tapering edge 74. The movement continues until the male pins 30 are inserted into the female receptacles 43. In this position the shuttle 40 is in its operational position. Those skilled in the art will recognize that flex circuit 54 must be designed so as to allow movement of the shuttle block 40 into its operational or second position.

Figure 4:
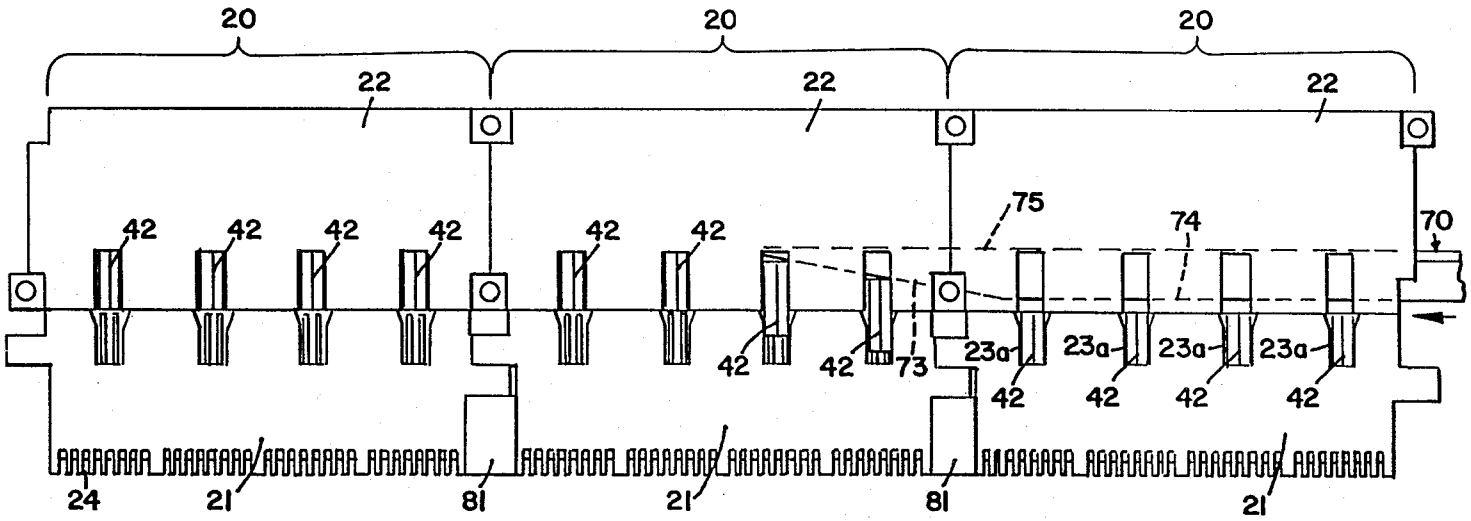
FIG. 4 is a top plan view of the connector of FIG. 1.

The insertion tool 70 continues through each of the four shuttles 40 of the preferred embodiment, located within the shuttle housing 22, through the second window of the shuttle housing 22 and into the next shuttle housing 22*b*. As is illustrated in FIG. 4, the tip of slide 70 is entering the middle connector 20 of connector 10 with the relative position of tabs 42 illustrating the movement of the sequential shuttle blocks 40. This process continues until all shuttles 40 of connector 10 have been urged transversely.

To disengage the connector 10, the insertion tool 70 is turned 180° about its longitudinal axis and inserted into the rear portion of guide means 80 and the process is reversed. By turning the tool 180°, the tapering edge 73 then faces way from the stationary blocks 21.

ALTERNATIVE EMBODIMENT

Figure 7:
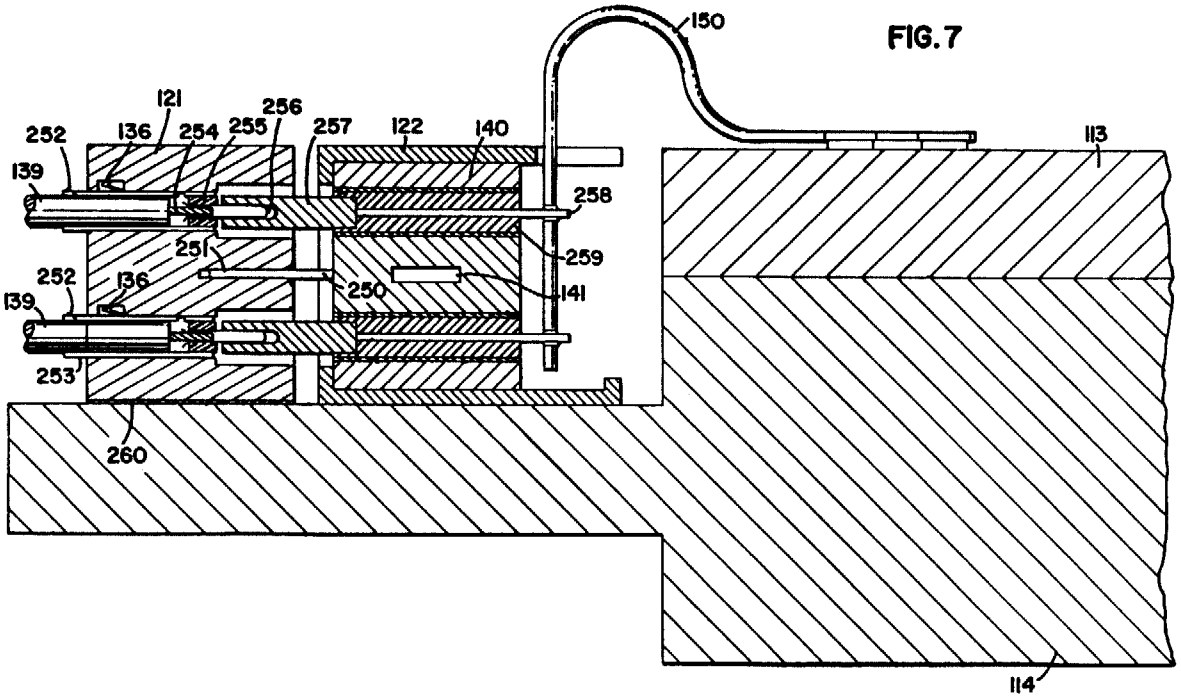
FIG. 7 is an alternative embodiment of the ZIF edge connector of FIG. 1, utilizing coaxial cable.

In FIG. 7, there is illustrated an alternative embodiment to the present invention. The principles of the present invention remain the same, as discussed above in connection with FIGS. 1–6 above. However, the alternative embodiment as illustrated in FIG. 7 utilizes coaxial cable 139 rather than twisted pair. Additionally, a locator pin 250 is utilized to help guide the alignment of the male pin 256 and female receptacle 257.

Those skilled in the art will recognize other certain modifications such as the style of locking pawl 136 which engages in a detente area 32 of electrically conductive stationary block 121, may be made. Also, those skilled in the art will recognize that the window 141 formed within shuttle 140 is located between the flex connector 150 and stationary block 121, rather than between the flex connection and the PC board as in the preferred embodiment described above. This alternative embodiment, therefore, provides for a one-shot type formation process of the shuttle 140. However, those skilled in the art will recognize that the window 141 placement is a matter of design choice, and that it similarly could be located behind the flex connection 150. Such location would further minimize the connection path and reduce impedance.

Although those skilled in the art are aware of coaxial type connections and the alternative embodiment's coaxial type environment connections, a brief description of the location and arrangement of the connector will be next described.

The outer shield of coaxial cable 139 is connected to member 253 via conducting means 252. Conducting means 252 is comprised of a strand of copper wire or other similar conductive material. Conducting member 253 extends through stationary member 121 and is insulated from the center wire 254 by means of nonconductive material 255. Conducting member 253 may be connected through detente 136 to "ground" potential as described further below. Center wire 254 is connected to male pin 256 by means of crimping, clamping, soldering or other connecting methods well known in the art.

Female connector 257 engages male pin 256 and conductive member 253 connects to metal stationary block 121. Female connector 257 is connected to flex circuit 150 as described above. Leads 258 between female connector 257 and flex circuit 150 are preferably encased in a nonconductive material 259 and may also be shielded if so desired. Block 121 may be metal and grounded or ungrounded as desired. Nonconductive layer 260 is optionally placed between block 121 and cold plate 14 dependent upon the desired ground path and whether block 121 is constructed of conductive materials.

In operation, alternative embodiment connector 10 operates in the manner as described above in connection with the first preferred embodiment.

It is to be understood that even though numerous characteristics and advantages of the present invention have been set forth in the foregoing description, together with details of the structure and function of the invention, the disclosure is illustrative only and changes may be made in detail, especially in matters of the location of the male and female pins (i.e., whether the male or female connector is located on the stationary or shuttle block), in the manner and means of biasing the stationary block to ensure proper alignment, the use of one or more windows in the shuttle block as well as the use of the alignment block and shape of the insertion tool, the number of pins used in the preferred embodiment, the number of shuttles located within each shuttle frame, the types of male and female connectors utilized, the construction and method of the guide means and the use of a flex circuit in connection with the shuttle block, to the full extent indicated by the broad general meaning of the terms in which the appended claims are expressed.

We claim:

1. An electrical connector, of the zero insertion force type, comprising:

(a) a first housing and a second housing, said first and second housings generally aligned side by side and said second housing having end walls defining guide holes;

(b) a first connector cooperatively mounted in said first housing and a second connector slideably mounted in said second housing, wherein said first and second connectors form an electrical path when mated with one another and wherein said second connector has a channel formed the interior of whereby when an insertion bar is selectively inserted through said guide holes and said channel, then said second connector cooperatively engages with or disconnect from said first connector.

2. The connector of claim 1, wherein each end wall of said second housing has two guide holes formed therethrough.

3. The connector of claim 2, further comprising guide means, located proximate said second housing, for accurately aligning said insertion bar through said guide holes and said channel.

4. The connector of claim 1, wherein said first housing is floatably mounted and biased with a spring and wherein said second housing is mounted on means for biasing said spring, whereby when said first and second housing are placed in side by side alignment said first housing is biased into accurate alignment with said second housing.

5. The connector of claim 1, wherein said first and second connectors include (1) a male device having male pins, and (2) a female connector having female receptacles, respectively.

6. The connector of claim 5, wherein said male device includes locking means for locking said male device into said connector.

7. The connector of claim 6, wherein said locking means includes a pawl-like projection for engaging with a detente located within said connector.

8. The connector of claim 6, wherein said male device includes tines, wherein each male device corresponds to an electrical path.

9. The connector of claim 1, wherein a guide tab is cooperatively connected to said second connector and a guide slot is formed in said first housing, whereby when said second connector is moved proximate said first housing, said guide tab engages in said guide slot, thus aligning said first and second connectors.

10. The connector of claim 5, wherein said opening of said female receptacles are chamfered so as to guide said male pins into said female receptacles.

11. The connector of claim 1, wherein a flex circuit is embedded in said second connector.

12. An electrical connector, comprising:

(a) a frame having two end walls with holes formed therein for receiving a slider;

(b) a plurality of slideable blocks, slidably disposed in said frame, said blocks having a channel formed through the interior thereof;

(c) a stationary block oppositely disposed from said slideable blocks;

(d) a male connector cooperatively connected to said stationary block;

(e) a female connector cooperatively connected to each slideable block, whereby said female connector are selectively urged into and out of contact with said male connector responsive to insertion of said slider through said holes and channel.

13. The connector as recited in claim 12, further comprising a plurality of frames and stationary blocks and male connectors wherein each of said stationary blocks corresponds to at least one of said slideable blocks.

14. The connector as recited in claim 13, wherein each of said stationary blocks has a hole formed therein and a respective said male connector is disposed therein.

15. The connector as recited in claim 14, wherein said slideable blocks are arranged side by side.

16. The connector as recited in claim 15, wherein said stationary blocks and said slideable blocks are made of a nonconductive material.

17. The connector as recited in claim 16, wherein said frames are mounted on a cold plate.

18. The connector as recited in claim 12, further comprising alignment pins mounted on said slideable blocks and alignment holes formed in said stationary block, whereby said male and female connectors are properly aligned.

19. The connector as recited in claim 12, further comprising alignment blades cooperatively connected to said slideable blocks, whereby said male and female connectors are properly aligned.

* * * * *

UNITED STATES PATENT AND TRADEMARK OFFICE

CERTIFICATE OF CORRECTION

PATENT NO. : 4,984,993

DATED : January 15, 1991

INVENTOR(S) : Eugene F. Neumann; Melvin C. August; Stephen A. Bowen, all of Chippewa Falls, Wis.

It is certified that error appears in the above-identified patent and that said Letters Patent is hereby corrected as shown below:

In the Abstract, line 6, for "housig" read --housing--.

In column 5, lines 53-55, for

"Connector section 20 is one of a plurality of connector sections, connector section 20a is one of a plurality of sections 20,"

read:

--Also, those skilled in the art will recognize that, while connector section 20 is one of a plurality of sections 20,--.

In column 5, line 64, insert --21-- after "block".

In column 7, lines 39 and 40, for "times" read --tines--.

UNITED STATES PATENT AND TRADEMARK OFFICE

CERTIFICATE OF CORRECTION

PATENT NO. : 4,984,993

DATED : January 15, 1991

INVENTOR(S) : Eugene F. Neumann, et al

It is certified that error appears in the above-identified patent and that said Letters Patent is hereby corrected as shown below:

In column 11, lines 44-45, for "formed the interior of" read --formed through the interior thereof--.

In column 11, line 48, for "disconnect" read --disconnects--.

In column 12, lines 36-37, for "connector" read --connectors--.

Please add the following Fig. 7: (Attached hereto in duplicate.)

Signed and Sealed this

Fifteenth Day of September, 1992

*Attest:*

DOUGLAS B. COMER

*Attesting Officer*

*Acting Commissioner of Patents and Trademarks*